US005374056A

United States Patent [19]

Scher et al.

[11] Patent Number: 5,374,056

[45] Date of Patent: Dec. 20, 1994

[54] BASEBALL PRACTICE DEVICE

[76] Inventors: Steven L. Scher, 24 Imperial Ave., Westport, Conn. 06880; Robert Moss, P.O. Box 486, New Canaan, Conn. 06840

[21] Appl. No.: 139,989

[22] Filed: Oct. 21, 1993

[51] Int. Cl.[5] ..... A63B 69/40

[52] U.S. Cl. ..... 273/26 E

[58] Field of Search ..... 273/29 A, 26 E, 58 C, 273/183 C, 184 B, 185 C, 185 D, 186 B, 197, 198, 200 B, 196

[56] References Cited

U.S. PATENT DOCUMENTS

| | | | |
|---|---|---|---|
| 3,366,383 | 1/1968 | Lentine | 273/26 E |
| 3,893,669 | 7/1975 | Myers | 273/29 A |
| 4,191,372 | 3/1980 | Keller | 273/29 A |

*Primary Examiner*—Theatrice Brown

*Attorney, Agent, or Firm*—Lieberman & Nowak

[57] ABSTRACT

A baseball practice device in which a baseball is releasably attached to a "Y" shaped tether system which, in turn, is supported by two horizontal arms arranged in a "Y" shaped configuration. The combination of the horizontal arms and the tether system allows simulation of a pitching environment where the baseball may be presented to the batter with a uniform and repeatable flight path to enhance batting practice.

5 Claims, 3 Drawing Sheets

BASEBALL PRACTICE DEVICE

FIELD OF THE INVENTION

This invention relates generally to sport training devices and/or toys and, more particularly, to a baseball practice device suitable for use by children or adults.

BACKGROUND OF THE INVENTION

Baseball is America's favorite sporting event and also has wide popularity in other areas of the world including Japan, Taiwan and South America. Numerous organizations exist in the U.S., and around the world, which function to introduce the sport to children, and extensive efforts are employed on a world-wide basis in teaching young children the skills necessary to play the game of baseball.

One of the most important skills required is the ability to hit the baseball, which often necessitates extensive practice, particularly for young players Just learning the sport.

A device often used for teaching young players the skill of hitting the baseball is the "Tee-Ball" approach, in which a baseball is placed on top of a support structure situated directly in front of the batting position. The player then swings the bat at the baseball (a stationary target) and thereby begins to develop the batting skills necessary for success in playing baseball. For a very young player just learning the game, the Tee-Ball approach has merit.

However, the drawback with the Tee-Ball approach is that the baseball is stationary and therefore does not give the player practice swinging at a moving object. Hitting a moving object is critical for success in the game of baseball, and the Tee-Ball approach does not provide the necessary practice skills to achieve this result. A current alternative, of course, is for a pitcher to pitch to the player but this technique often is unsatisfactory, as it depends on the skill and patience of the pitcher. More importantly, each pitch does not present a uniform flight path for the baseball and, therefore, the player, particularly the young player, still has difficulty hitting the ball due to the variation in the flight path for each pitch.

A second alternative is the use of mechanical pitching devices, but these devices are extremely expensive, difficult to use, and can be dangerous for young players due to the speed of the ball being pitched.

It is, therefore an object of the instant invention to provide a batting practice device that is inexpensive, that provides a uniform flight path for the baseball when the baseball is released for batting practice, and is easy to use.

Various prior art patents exist which attempt to provide a batting practice device in which a ball is tethered or suspended in various ways to simulate a pitching environment. One such device is described in U.S. Pat. No. 3,301,556 granted to R. M. Hamilton, Jr., et al on Jan. 31, 1967. The batting practice device described in this patent consists of an overhanging cone-like structure with means to hold a tethered ball in position to be struck by a bat. The ball holding device releasably holds the ball so that the batter may practice swings for striking a ball, whether at rest or moving in a flight path to a designated position. The ball holding structure is adjustable as to height and front-to-back arrangement as well as adjustable to bring the ball down to a desired elevation above the batting position.

A second such device is shown in U.S. Pat. No. 3,716,235 granted to John W. Yerkio, Jr. on Feb. 13, 1973. This device consists of an elongated support structure including a pair of parallel, co-planer support arms between which is connected a cross arm. A tether is suspended from the cross arm and the baseball is releasably connected to the tether to permit the batter to strike the baseball.

Similar devices are shown in U.S. Pat. Nos. 3,397,885, 3,454,275, 3,529,823, 3,893,699, 4,830,372, 4,898,385, 5,048,828 and 5,098,094.

The problem with all of the foregoing batting practice devices is that the tethered ball does not return in a uniform flight path to the batter when the ball is raised in elevation and released for the batter. This result stems from the fact that the ball is generally suspended from a single tether so that when the ball is released to the batter, the flight path will vary, thereby making it much more difficult for the batter to effectively hit the baseball.

It is therefore a further object of the instant invention to provide a batting practice device that produces a uniform flight path for the baseball when released for a swing by the batter.

It is a still further object of the instant invention to provide a batting practice device which accurately simulates a pitching environment by suspending the ball in such a way that it will accurately return to the batter upon each occasion of presenting the ball to the batter for batting practice.

SUMMARY OF THE INVENTION

In accordance with the instant invention, a batting practice device is provided which includes a base element, an upstanding vertical element releasably affixed to the base element and a horizontal element releasably affixed to a top portion of the vertical element.

It is a feature of the invention that the horizontal element has two horizontal extending arms in a "Y" shaped arrangement from which is suspended a tether having first and second upper portions connected to each of said horizontal extending arms and a lower portion from which a baseball is releasably attached.

It is a further feature of the invention that the baseball can either be struck from a stationary position or can be elevated and released by a batting assistant so that the "Y" shaped horizontal extending arms and tether will ensure a uniform flight path upon return of the baseball to the batter.

It is a further feature of the invention that both the upstanding vertical element and the horizontal extending arms are adjustable in height and length, respectively.

Other objects and features of the present invention will become apparent upon reading the following specification and referring to the accompanying drawings, which form a material part of this invention.

DETAILED DESCRIPTION OF THE DRAWINGS

Figure 1:
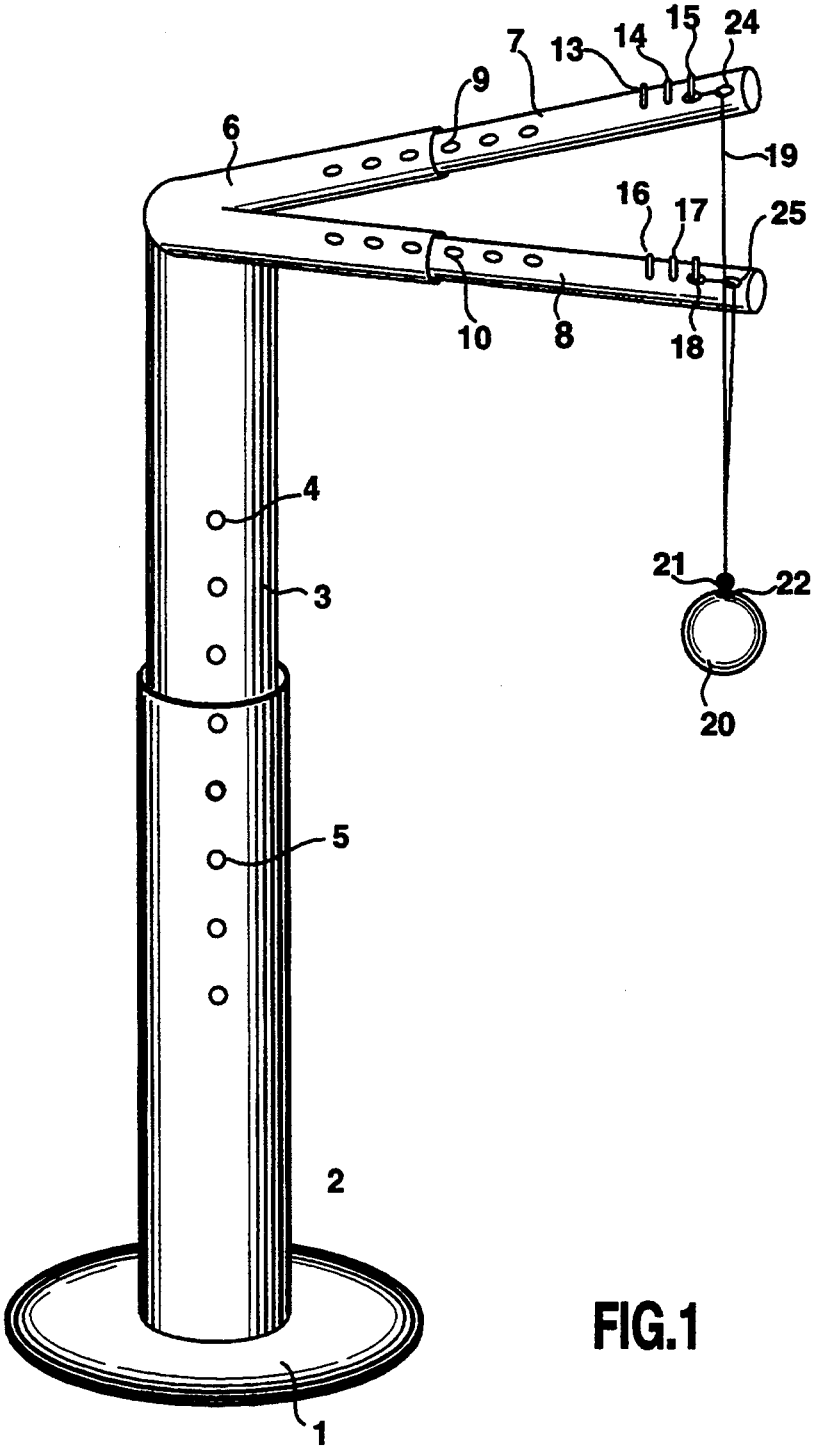
FIG. 1 illustrates a side view of the baseball practice device of the instant invention.

Referring now to FIG. 1, there is shown the batting practice device of the instant invention. The device consists of base 1, vertical members 2 and 3, and horizontal members 6, 7 and 8. Vertical member 2 is affixed to base 1, preferably by a screw type arrangement in which vertical member 2 is screwed into base 1. However, it is understood that various other means of connecting vertical member 2 to base 1 can be employed. Vertical member 3 is smaller in diameter than vertical member 2 and is arranged such that the vertical height of the batting practice device can be adjusted by member 3 sliding within member 2. Securing member 3 to member 2 can be done by affixing securing pins within the holes provided in the vertical members, such as holes 4 and 5.

Horizontal member 6 is a Y-shaped member which is affixed to the top of vertical member 3. It is, of course, understood that member 6 can be affixed to member 3 in a number of ways, but preferably it would rest within member 3 and be secured by various fastening means known to one skilled in the art. Members 7 and 8 are arranged to fit within the hollow arms of member 6. Members 7 and 8 can be adjusted in length by sliding those members within the Y-shaped portion of member 6. Again, members 7 and 8 are secured to the Y-shaped portion of member 6 by placing securing pins or other fastening means within holes 9 and 10.

Attached to the outboard portion of members 7 and 8 is a Y-shaped tether 19 which is threaded through apertures 24 and 25 at the ends of members 7 and 8. The tether is then attached to pins 13, 14 and 15, or 16, 17 and 18, in any suitable manner such that the vertical distance between the ball and the batter can be adjusted to compensate for the height of individual players who will be using the batting practice device.

Cord 19 has affixed on the lower end of an attachment point 21, a hook and loop fastener material, such as Velcro. Ball 20, for use with the batting practice device, also has attached on the top thereof a similar hook and loop fastening material 22, which will attach to fastening point 21. It is understood that cord 19 can be a standard rope, or could consist of "bungy" cords, for example, to provide additional flexibility when using the batting practice device.

Figure 2:
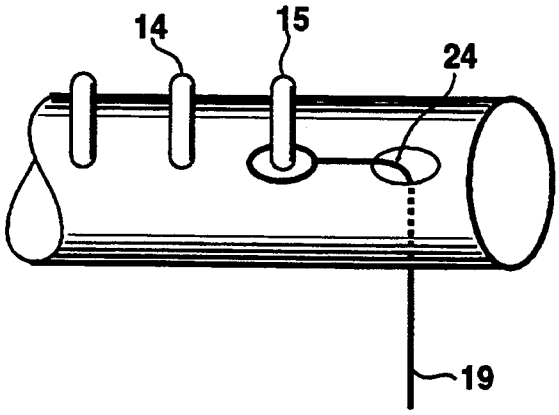
FIG. 2 illustrates the manner in which a tether is attached to the baseball practice device.

FIG. 2 illustrates in greater detail the manner in which tether 19 is attached to pin 15 after being passed through aperture 24.

Figure 3:
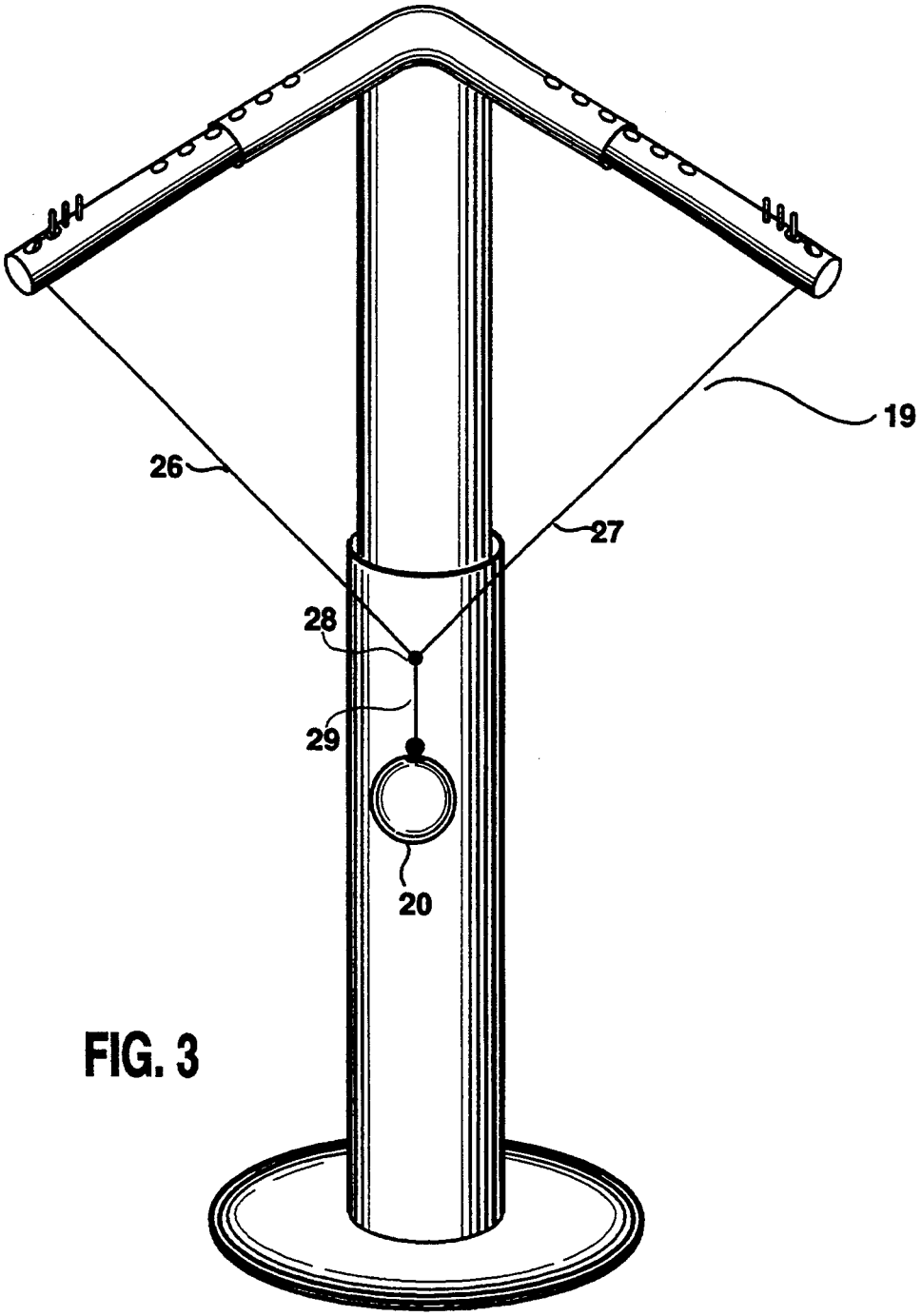
FIG. 3 illustrates a front view of the baseball practice device of the instant invention.

FIG. 3 shows a front view of the batting practice device, which illustrates the fact that the ball 20 is suspended in a Y-shaped tether 19, such that the ball 20 will be situated precisely in front of the batting practice device. In operation, the player may strike ball 20 in a stationary position as it hangs from cord 19. Alternatively, it is possible for the player, or a player assistant, to swing ball 20 in an arc away from the batter, allowing the ball 20 to return on the same arc, thereby allowing the batter to strike at a moving object which will always return on the same flight path to the batter due to Y-shaped tether 19 and Y-shaped arms 7 and 8. Tether 19 consists of two sections 26 and 27 connected at connection point 28 with a third section 29.

The advantage of the instant invention is due to Y-shaped member 19, which ensures that ball 20 will always return in the same flight path directly to the center of the batting practice device. Accordingly, in this manner, the player has access to attempting to hit a moving object, ball 20, but most importantly, ball 20 always returns in the same flight path such that the batter can develop his skills uniformly without the necessity for a pitcher to accurately pitch on the same flight path on every occurrence.

It is also understood that when the batter hits ball 20, the hook and loop fastener attachment at 21 and 22 will release, thereby allowing the ball to be propelled in the direction that it is being hit. In addition, it is possible, if necessary, to affix a string to ball 20, which string would be attached, for example, to base 1 of the baseball practice device. In this manner, as the ball is hit, it can be easily retrieved by the player by simply pulling on the string to retract the ball for replacement at hook and loop fastening points 21 and 22 for further action. In addition, it is understood that for sustained practice a plurality of balls 20 would be provided, such that the player could repetitively attach balls 20 to the Y-shaped suspension mechanism 19 and thereby hit a number of balls in succession to further perfect the skills necessary for the game of baseball.

While one embodiment of the invention and modifications thereof have been disclosed in detail, it will be understood that other embodiments and modifications are contemplated by the inventor. For example, vertical members 4 and 5 could be replaced with any other type of support mechanism as well as horizontal members 6, 7 and 8. The key to the instant invention is Y-shaped mechanism 19, which ensures that ball 20 will always return on the same flight path to give the batter consistent practice in developing skills for the game of baseball. It is the intention to include all such modifications .and embodiments as are defined by the appended claims within the scope of the invention.

What is claimed is:

1. A batting practice device comprising:

a base element, an upstanding vertical element being affixed to said base element, said vertical element being adjustable in height, a horizontal element being affixed to a top portion of said vertical element, said horizontal element being comprised of two horizontal arms extending from said top portion of said vertical element in a "Y" shaped arrangement, tether means having a first upper portion affixed to one of said horizontal extending arms and a second upper portion affixed to said second of said horizontal extending arms, said first and second upper portions being connected together at a connection point, to which is further connected a vertically extending lower portion of said tether means, and a ball releasably secured to a lower end of said lower portion of said tether means.

2. A batting practice device in accordance with claim 1, wherein said two horizontal extending arms are adjustable in length.

3. A batting practice device in accordance with claim 2, wherein each of said two horizontal extending arms include a plurality of upstanding pins predeterminably spaced on an upper surface of each of said two horizontal extending arms and an aperture located at an outer end of each of said two horizontal extending arms.

4. A batting practice device in accordance with claim 3, wherein said first and second upper portions of said tether means are inserted through said aperture located in each of said two horizontal extending arms and releasably attached to selected ones of said upstanding pins.

5. A batting practice device in accordance with claim 4, wherein said first and second upper portions of said tether means are of equal length.

* * * * *